US006981903B2

(12) United States Patent
Trentelman

(10) Patent No.: US 6,981,903 B2
(45) Date of Patent: Jan. 3, 2006

(54) EXTERNAL ELECTRODE DRIVEN DISCHARGE LAMP

(75) Inventor: Jackson P. Trentelman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 229 days.

(21) Appl. No.: 10/461,552

(22) Filed: Jun. 11, 2003

(65) Prior Publication Data

US 2003/0211805 A1 Nov. 13, 2003

Related U.S. Application Data

(62) Division of application No. 09/647,078, filed as application No. PCT/US98/23722 on Nov. 9, 1998, now Pat. No. 6,603,248.

(60) Provisional application No. 60/079,198, filed on Mar. 24, 1998.

(51) Int. Cl.
*H01J 9/00* (2006.01)
*H01J 9/20* (2006.01)

(52) U.S. Cl. ..... 445/22; 445/26; 445/27

(58) Field of Classification Search ..... 445/22, 445/26, 27

See application file for complete search history.

(56) References Cited

U.S. PATENT DOCUMENTS

| | | | | |
|---|---|---|---|---|
| 2,102,049 | A | 12/1937 | Warren | 445/24 |
| 3,226,590 | A | 12/1965 | Christy | 313/493 |
| 3,646,383 | A | 2/1972 | Jones et al. | 313/493 |
| 4,266,166 | A | 5/1981 | Proud et al. | 315/248 |
| 4,266,167 | A | 5/1981 | Proud et al. | 315/248 |
| 4,500,810 | A | 2/1985 | Graff | 313/486 |
| 5,013,959 | A | 5/1991 | Kogelschatz | 313/36 |

(Continued)

FOREIGN PATENT DOCUMENTS

DE 196 38 709 A1 4/1998

(Continued)

*Primary Examiner*—Mariceli Santiago
(74) *Attorney, Agent, or Firm*—Siwen Chen

(57) ABSTRACT

A discharge lamp, such as a neon lamp, comprising a laminated envelope having a gas-discharge channel and at least one external electrode in communication with the gas-discharge channel, the laminated envelope having a front surface and a back surface integrated together to form a unitary envelope body essentially free of any sealing materials. The external electrode comprises an electrode surface integral with the laminated envelope and a conductive medium disposed on the electrode surface. The conductive medium may be conductive tape, conductive ink, conductive coatings, frit with conductive filler or conductive epoxies. The discharge lamp may comprise a laminated envelope including a plurality of separate gas-discharge channels and external electrodes in communication with the gas-discharge channels, whereby the discharge is driven in parallel.

24 Claims, 8 Drawing Sheets

U.S. PATENT DOCUMENTS

| | | | | |
|---|---|---|---|---|
| 5,041,762 | A | 8/1991 | Hartai | 315/169.3 |
| 5,203,927 | A | 4/1993 | Yoshida et al. | 134/21 |
| 5,233,262 | A | 8/1993 | Lynn et al. | 313/113 |
| 5,276,378 | A | 1/1994 | Gothard | 313/491 |
| 5,289,085 | A | 2/1994 | Godyak et al. | 315/248 |
| 5,334,258 | A | 8/1994 | Osano et al. | 134/42 |
| 5,463,274 | A | 10/1995 | Winsor | 313/493 |
| 5,466,990 | A | 11/1995 | Winsor | 315/56 |
| 5,479,069 | A | 12/1995 | Winsor | 313/493 |
| 5,592,047 | A | 1/1997 | Park et al. | 313/484 |
| 5,708,331 | A | 1/1998 | Vamvakas et al. | 315/248 |
| 5,834,888 | A | 11/1998 | Allen et al. | 313/484 |
| 5,868,864 | A | 2/1999 | Nishi | 134/30 |
| 6,087,784 | A | 7/2000 | Quinn et al. | 315/246 |
| 6,323,593 | B1 | 11/2001 | Anderson et al. | 313/493 |
| 6,362,568 | B1 | 3/2002 | Anderson et al. | 313/623 |
| 6,429,581 | B1 | 8/2002 | Trentelman | 313/493 |

FOREIGN PATENT DOCUMENTS

| | | |
|---|---|---|
| EP | 0 745 565 | 12/1996 |
| JP | 8-318232 | 12/1996 |
| JP | 9-125276 | 5/1997 |
| JP | 9-239332 | 9/1997 |
| RU | 2077374 | 4/1997 |

EXTERNAL ELECTRODE DRIVEN DISCHARGE LAMP

This is a divisional application claiming the benefit of U.S. application, Ser. No. 09/647,078, filed Sep. 22, 2000, entitled EXTERNAL ELECTRODE DRIVEN DISCHARGE LAMP, and filed by Jackson P. Trentelman, now U.S. Pat. No. 6,603,248 which is a 371 of PCT/US98/23722 filed Nov. 9, 1998, which claims the benefit of Provisional Application No. 60/079,198, filed Mar. 24, 1998.

BACKGROUND OF INVENTION

1. Field of Invention

The present invention relates to a low-pressure discharge lamp in which external electrodes are employed to drive an electrical gas discharge confined within a laminated envelope. More particularly the present invention relates to such a discharge lamp which could be utilized for the purpose of automotive rear lighting applications.

2. Description of Related Art

In the neon signage industry, the standard type of electrode employed in low-pressure discharge lamps is the internal electrode. Internal electrodes, as the name provides, are located within the glass tubing and typically consist of a metal shell coated with an emissive coating. A connection to an external power source is made via a wire which is glass-to-metal sealed in the tubing see generally W. Strattman, *Neon Techniques, Handbook of Neon Sign and Cold Cathode Lighting*, ST Publications, Inc., Cincinnati, Ohio (1997).

A significant problem associated with low-pressure discharge lamps comprising internal electrodes is a reduction in lifetime due to electrode failure resulting from bombardment of the electrode by gas ions, and sputtering away of material from the electrode. Further, failure in these discharge lamps is also associated with leakage at the glass-to-metal seal i.e., at the seal between the glass envelope and the electrode. This mode of failure is particularly true in discharge lamps having borosilicate-to-tungsten wire seals.

In contrast to internal electrodes, the activation of an ionizable gas by external electrodes eliminates the aforementioned destruction of electrodes, resulting in longer lamp life, i.e., external electrodes are on the outside of the glass tubing and therefore are not subject to bombardment by gas ions. The term "external electrodes" is meant to refer to electrodes that are not internal to a glass article containing an ionizable gas.

An additional feature of driving a discharge through external electrodes is that multiple separate channels can be driven in parallel, unlike driving a discharge through internal electrodes, which will only follow the path of least resistance.

Capacitive coupling to a low-pressure discharge, i.e., driving a discharge through external electrodes has been disclosed in U.S. Pat. No. 4,266,166 Proud et al.) and U.S. Pat. No. 4,266,167 (Proud et al.). U.S. Pat. No. 4,266,166 discloses a fluorescent lamp comprising a pear-shaped glass envelope with a reentrant cavity in the lamp envelope. An outer and inner conductor, typically a conductive mesh, is disposed on the outer surface of the envelope and on the reentrant cavity surface, respectively. Similarly, U.S. Pat. No. 4,266,167 discloses a fluorescent lamp comprising a pear-shaped glass envelope with a reentrant cavity. An outer conductor, typically a conductive mesh, is disposed on the outer surface of the lamp envelope, and an inner conductor, typically a solid conductive device, fills the reentrant cavity.

Both patents disclose the use of a high frequency of operation, in the range of 10 MHz to 10 GHz.

A fluorescent lamp wherein a twin-tube lamp envelope comprises electrodes at or near the ends thereof for capacitive coupling to a low pressure discharge lamp is disclosed in U.S. Pat. No. 5,289,085 (Godyak et al.). Externally located electrodes comprising metal layers or bands at or near the ends of the tube envelope are disclosed. Frequencies in the range of 3 MHz to 300 MHz are suggested.

U.S. Pat. No. 5,041,762 (Hartai) discloses a luminous panel comprising a flat glass envelope formed from two plates of glass, the flat glass envelope comprising a gas discharge channel formed by machining a groove on the surface of the plates. Although the preferred embodiment discloses internal electrodes, electrodes of the capacitive type are also suggested.

OBJECTS AND ADVANTAGES

An object of the present invention is to provide a discharge lamp for use in automotive rear lighting applications having packaging simplicity, long life, energy and cost efficiency by employing external electrodes to drive an electrical gas discharge confined within a laminated envelope.

Another object of the present invention is to optimize the capacitive reactance the external electrode site by manipulating the electrode's geometry with the laminated envelope forming process.

SUMMARY OF THE INVENTION

According to the present invention, these and other objects and advantages are achieved in a discharge lamp comprising a laminated envelope and external electrodes for inducing an electrical gas discharge. The laminated envelope comprises at least one gas-discharge channel and an ionizable gas confined within the gas discharge channel. The ionizable gas is activated by external electrodes which are in communication with the gas-discharge channel. The external electrodes comprise an electrode surface and a conductive medium on the electrode surface. The electrode surface is integral with the body of the laminated envelope.

BRIEF DESCRIPTION OF THE DRAWINGS

The above and other objects, features and advantages of the present invention will be apparent from the following description of preferred embodiments of the invention, with reference to the accompanying drawings, in which.

DETAILED DESCRIPTION OF THE PREFERRED EMBODIMENTS

Figure 1:
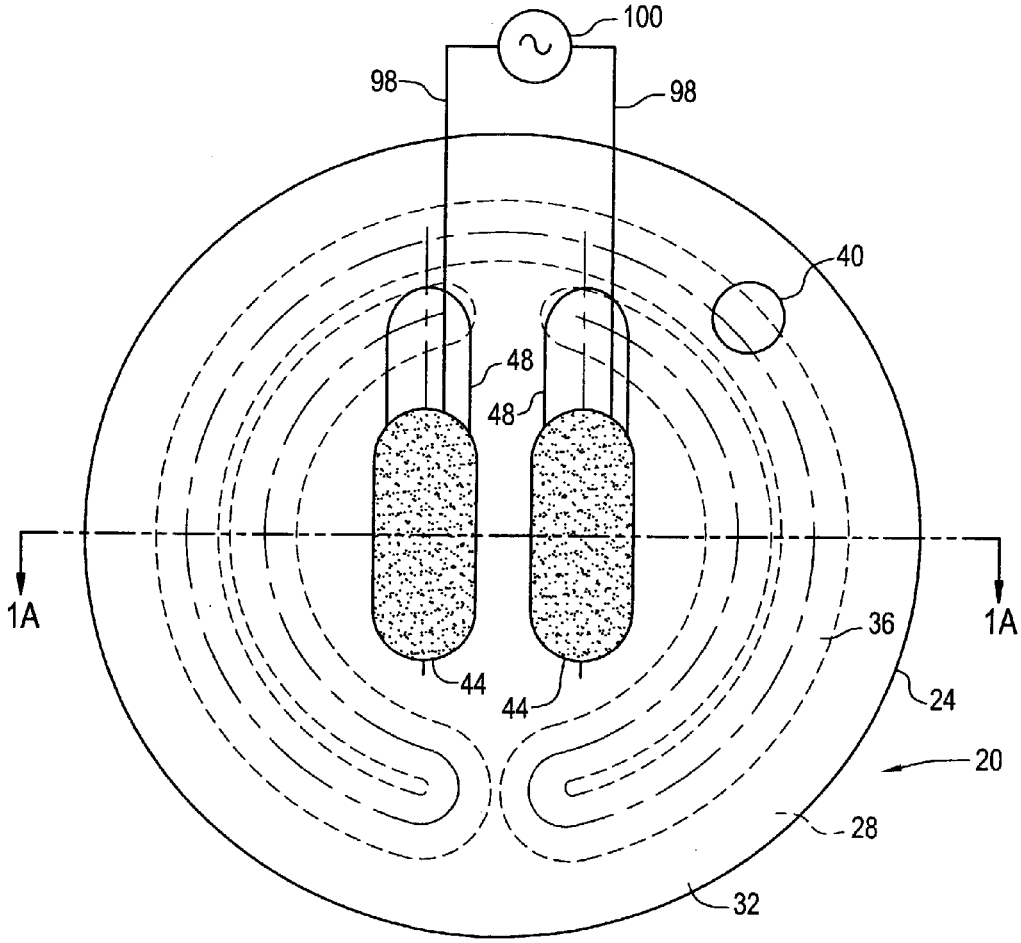
FIG. 1 is a plan view of a discharge lamp comprising a laminated envelope, the laminated envelope containing a gas-discharge channel and a pair of external electrodes in communication with the gas-discharge channel.

The present invention is based on a discharge lamp containing a laminated envelope with at least one gas-discharge channel, wherein the discharge is driven by external electrodes, the electrodes comprising a electrode surface integral with the laminated envelope and a conductive medium disposed on the electrode surface.

The laminated envelope of the present invention is made according to the methods disclosed in U.S. patent application Ser. No. 08/634,485 (Allen et al.), and in U.S. Pat. No. 5,834,888 (Allen et al.) and Co.-Pending U.S. Provisional Pat. Appln. Ser. No. 60/076,968 having the title "Channeled Glass Article and Method Thereof" and having Stephen R. Allen as sole inventor; co-assigned to the instant assignee and herein incorporated by reference.

In U.S. patent application Ser. No. 08/634,485 (Allen et al.), and in U.S. Pat. No. 5,834,888 (Allen et al.) the method of forming glass envelopes containing internally enclosed channels or laminated envelopes comprises the following steps: (a) delivering a first or channel-forming ribbon of molten glass to a surface of a mold assembly having a mold cavity possessing at least one channel-forming groove formed therewithin and a peripheral surface, wherein the channel-forming ribbon overlies the mold cavity and the peripheral surface of the mold assembly; (b) causing the channel-forming ribbon of molten glass to substantially conform to the contour of the mold cavity resulting in the formation of at least one channel in the ribbon of the molten glass; (c) delivering and depositing a second or sealing ribbon of molten glass to the outer surface of the channel-forming ribbon of molten glass wherein the viscosity of the sealing ribbon is such that the sealing ribbon bridges but does not sag into contact with the surface of the channel of the channel-forming ribbon but is still molten enough to form a hermetic seal wherever the sealing ribbon contacts the channel-forming ribbon, thereby resulting in a glass article possessing at least one enclosed channel; and, (d) removing the glass article from the mold. Conformance of the channel-forming molten glass ribbon to the mold cavity is attained by gravity forces, vacuum actuation or a combination of both. The glass envelope formed by the above described method comprises a front surface and a back surface laminated and integrated together to form a unitary envelope body essentially free of any sealing materials and having at least one gas discharge channel. The laminated glass envelope exhibits a weight to area ratio of $\leqq 1.0$ g/cm$^2$.

In Co.-Pending U.S. Provisional Pat. Appl. Ser. No. 60/076,968 the method of forming glass envelopes or laminated envelopes comprises the following steps: (a) delivering and depositing a first or channel-forming ribbon of molten glass to a surface of a mold assembly having a mold cavity possessing at least one channel-forming groove formed therewith and a peripheral surface, wherein the channel-forming ribbon overlies the mold cavity and the peripheral surface of the mold assembly; (b) causing the channel-forming ribbon of molten glass to substantially conform to the contour of the mold cavity resulting in the information of at least one channel in the ribbon of the molten glass; (c) delivering and depositing a second or sealing ribbon of molten glass to the outer surface of the channel-forming ribbon of molten glass wherein the viscosity of the sealing ribbon is such that the sealing ribbon (i) bridges but does not sag into complete contact with the surface of at least one channel of the channel-forming ribbon and (ii) forms a hermetic seal wherever the seal ribbon contacts the channel-forming ribbon to form a glass article with at least one enclosed channel; (d) causing the sealing ribbon to stretch so that the sealing ribbon has a thin cross-section and so that the hermetic seal between the sealing ribbon and the channel ribbon has a thin cross-section; and, (e) removing the glass article from the mold. The glass envelope formed by the above described method comprises a front surface and a back surface laminated and integrated together to form a unitary envelope body essentially free of any sealing materials and having at least one gas discharge channel, wherein the gas-discharge channel has a front surface having a thin cross-section and wherein the laminated glass envelope has a thin cross-section. The laminated glass envelope exhibits a weight to area ratio of $\leqq 1.0$ g/cm$^2$.

Figure 1A:
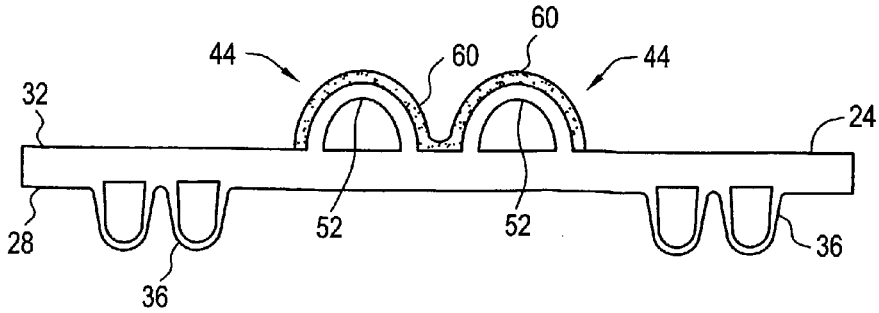
FIG. 1A is a cross section on line X—X of FIG. 1.

FIGS. 1 and 1A present a typical embodiment of the discharge lamp of the present invention.

Discharge lamp 20 comprises a laminated envelope 24 having a front surface 28 and a back surface 32 laminated and integrated together to form a unitary body essentially free of any sealing materials. Laminated envelope 24 preferably exhibits a weight to area ratio of $\leqq 1.0$ g/cm$^2$. Laminated envelope 24 includes gas-discharge channel 36. Tubulation port 40 is in communication with the external environment and gas-discharge channel 36. At tubulation port 40, gas-discharge channel 36 is evacuated and backfilled with an ionizable gas. After evacuation and backfilling, tubulation port 40 is sealed, whereby communication with the external environment is discontinued.

Any of the noble gases or mixtures thereof may be used for the ionizable gas, including but not limited to neon, xenon, krypton, argon, helium and mixtures thereof with mercury. In a preferred embodiment discharge lamp 20 is a neon lamp. A pressure preferably of 5–6 torr is used for neon.

Laminated envelope 24 disclosed hereinabove is preferably comprised of a transparent material such as glass selected from the group consisting of soda-lime silicate, borosilicate, aluminosilicate, boro-aluminosilicate and the like.

External electrodes 44 are in communication with, and located at each end of gas-discharge channel 36. Communication between external electrodes 44 and gas-discharge channel 36 is achieved via passageways 48. It is to be understood, however, that passageway 48 is present only for styling or process related reasons. Alternatively, passageway 48 may be removed, whereby the gas-discharge channel is contiguous with the external electrodes. It may also be contemplated to apply a conductive medium to the passageways, whereby the passageways effectively become part of the external electrode structure.

A ballast or a high voltage source 100 is connected to the external electrodes via connector leads 98 to drive the discharge. Suitable ballasts and connector leads are well known in the art.

Referring now to FIG. 1A, external electrode 44 comprises electrode surface 52 and conductive medium 60 disposed on said electrode surface 52. Electrode surface 52 forms an elongated receptacle. A key aspect of the present invention is that the electrode surface is integral with the laminated envelope structure. As such, the envelope forming process herein above described requires modification to allow for simultaneous formation of at least one electrode surface integral with the laminated envelope. This can be achieved by modifying the mold cavity to include an electrode surface-forming groove, whereby there is formation of a laminated envelope comprising a gas-discharge channel and an electrode surface.

As used herein "electrode surface" refers to that section of the laminated envelope which if coated with a conductive medium forms an external electrode capable of coupling to a power source. It is to be understood that the described method of electrode surface formation is a preferred embodiment and that other methods of formation can be utilized to achieve a similar envelope structure, one such being separate formation of an electrode surface receptacle and attachment thereof to the discharge channel via a sealant such as a glass frit.

The discharge lamp shown in FIGS. 1 and 1A comprises a laminated envelope with two external electrodes. Alternatively, a laminated envelope comprising one electrode surface integral with the body of the laminated envelope and a conductive medium disposed on the electrode surface is suitable for the present invention. A discharge lamp comprising a laminated envelope with one external electrode and one gas-discharge channel is capable of illumination since, as it is well known, the surrounding environment is a conductive medium and hence effectively becomes a second external electrode. Nonetheless, to achieve optimum operating conditions in a discharge lamp comprising the above described laminated envelope a second external electrode should be provided, i.e., application of conductive tape or a separate, external electrode glass structure to the laminated envelope whereby the second electrode is in communication with the gas-discharge channel.

In the present invention it has been found that the ability to couple effectively is a direct result of the envelope forming process herein above described. More specifically, the forming process is particularly suitable for producing external electrodes having a maximum electrode area and a minimum electrode thickness. The terms "electrode area" and "electrode thickness" refer to the area of the conductive medium disposed on the electrode surface, and to the thickness of the glass at the electrode surface, respectively.

Figure 2:
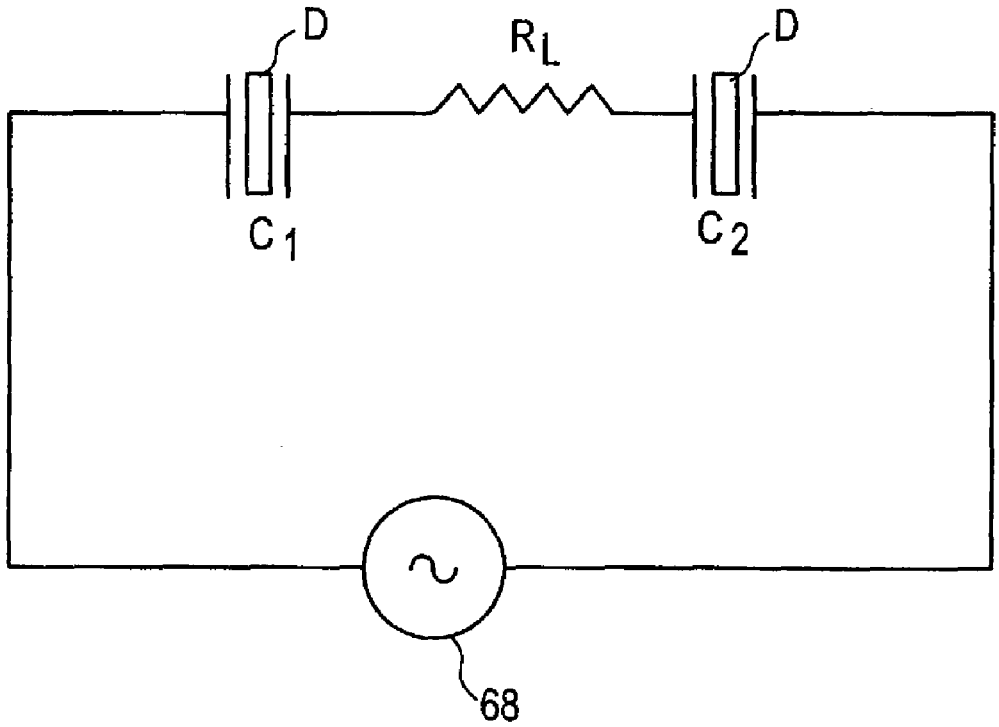
FIG. 2 is an equivalent, parallel-plate circuit of the discharge lamp shown in FIG. 1.

The importance of electrode area and electrode thickness in the present invention becomes apparent after an investigation of FIG. 2. This figure presents a simple, parallel-plate RC circuit of discharge lamp 20, herein illustrated in FIGS. 1 and 1A. The RC circuit is connected to a ballast 68. The schematic shows in series, two parallel-plate capacitors $C_1$ and $C_2$, each having a dielectric D, and a resistance $R_L$. The two parallel-plate capacitors represent external electrodes 44 and the ionizable gas in gas-discharge channel 36, which effectively form the conductors of capacitors $C_1$ and $C_2$. The ionizable gas in gas-discharge 36 is a conductive medium and has an effective resistance represented by $R_L$. The glass of gas-discharge channel 36 effectively acts as dielectric D between the conductors of capacitors $C_1$ and $C_2$.

It is well known that the capacitance (C) of filled capacitors $C_1$ and $C_2$, in a parallel-plate capacitor, is given by the formula:

$$C=\kappa(\in_0 A/d)$$

where

κ=dielectric constant $\in_0$=permitivity of space ($C^2/N\cdot m^2$)

A=electrode area d=electrode thickness.

The capacitive reactance ($C_R$) associated with capacitors $C_1$ and $C_2$ is given by the formula:

$$C_R=1/(2\pi fC)$$

where $f$=frequency of ballast 68

C=capacitance.

A preferred situation is attained when $C_R$ is small. At low values of $C_R$, excess voltage across the electrode is small thereby reducing the maximum voltage requirement of the ballast. The light output of the discharge lamp is optimized by tuning the drive circuit to the load impedance. This is most easily achieved when $C_R$ is small compared to $R_L$, i.e., when $C_R$ is a fraction of $R_L$.

Low values of $C_R$ are obtained by increasing C or by using high frequencies of operation, i.e., 10 MHz to 1 GHz or more. High frequencies of operation, however, are expensive and lead to other problems such as high electromagnetic interference. In order to meet customer requirements of low cost and energy efficiency, an objective of the present invention is to use low operating frequencies, preferably in the range of 100 kHz to 1000 kHz, and most preferably about 250 kHz.

Therefore, in order to operate at low frequencies and to have low values of $C_R$, C must be large. C for a filled capacitor is inversely proportional to the thickness of the dielectric, and proportional to the surface area of the conductors. In the present invention, a large C is obtained by decreasing the electrode thickness and increasing the electrode area.

As described herein above a small electrode area and thickness are achieved via the envelope forming process. Briefly and more specifically, the stretching of the glass during the forming process to the contour of a preformed mold cavity by gravity, vacuum actuation or a combination of both, renders a structure of maximum area and minimum thickness at the electrode site. Therefore, in the present invention $C_R$ is a function of the envelope forming process.

For effective coupling at 250 kHz, the electrode surface area is in the range of 6.54-25.81 $cm^2$, and the electrode thickness is in the range from 0.5 mm to 1.5 mm, preferably about 0.75 mm.

The present invention allows for discharge lamp designs incorporating equivalent light output by decreasing the gas-discharge channel length and increasing the current correspondingly. Increasing the current and hence sputtering does not have an effect on the external electrodes since their location is on the outside of the envelope and not in direct contact with the ionizable gas ions.

The present invention is illustrated by the nonlimiting examples given in the following Table. Neon discharge lamps comprising laminated envelopes were driven with both internal and external electrodes. Example 1 is a discharge lamp comprising a laminated envelope having a gas-discharge channel of 210 cm, the channel having a non-circular inner diameter of approximately 8 mm. Example 2 is a discharge lamp comprising a laminated envelope having a gas-discharge channel of 37 cm, the channel having a non-circular inner diameter of approximately 5 mm. Example 3 is a discharge lamp comprising a laminated envelope having a gas-discharge channel of 140 cm, the channel having a non-circular diameter of approximately 5 mm. Example 4 is a discharge lamp comprising a laminated envelope having a gas-discharge channel of 55 cm, the channel having alternating wide and narrow sections and an inner diameter in the narrow sections of 3 mm.

Examples 1, 2, and 3 have an electrode thickness of 0.75 mm, and Example 4 has an electrode thickness of 0.50 mm.

The power source for the internal electrodes was a 30 mA DC driven ballast. The operating point was chosen as the point at which the light emitting efficiency was the greatest, i.e., at a lamp resistance of 50 kohm. An equal light output condition was maintained for the internal and external electrode configurations. The power source for the external electrodes was a variable frequency plasma generator.

In each example, the light emitting efficiency is the same for both internal and external electrode configurations, within experimental error. Hence, in a discharge lamp of the present invention external electrodes provide the same or better light emitting efficiency as an internal electrodes, with the added advantage of no sputtering or leakage failure mechanisms at the electrode site.

Figure 3:
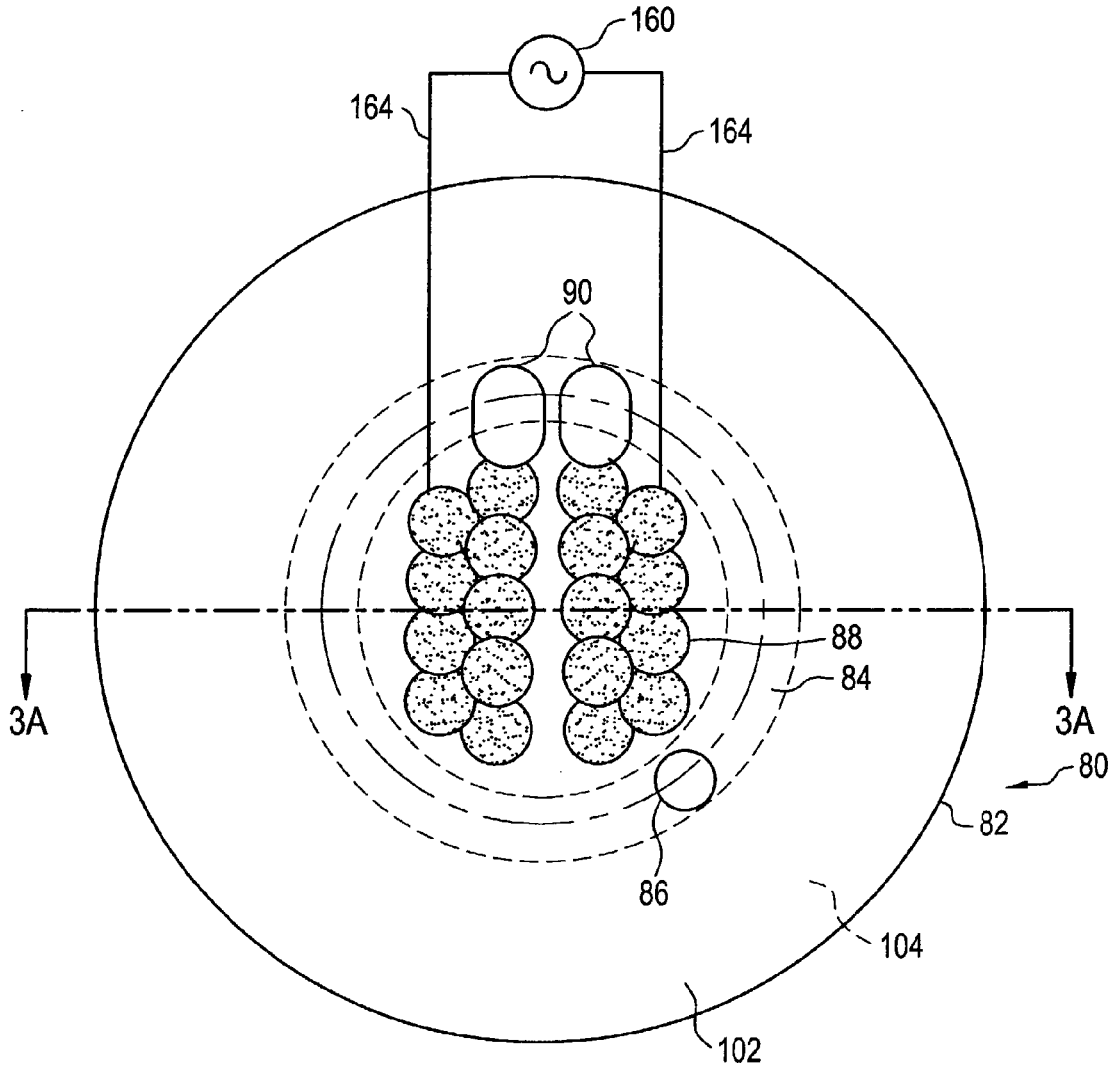
FIG. 3 is a plan view of a discharge lamp comprising a laminated envelope, the laminated envelope containing a gas-discharge channel and a pair of external electrodes of a different geometry than the external electrodes of FIG. 1.
Figure 3A:
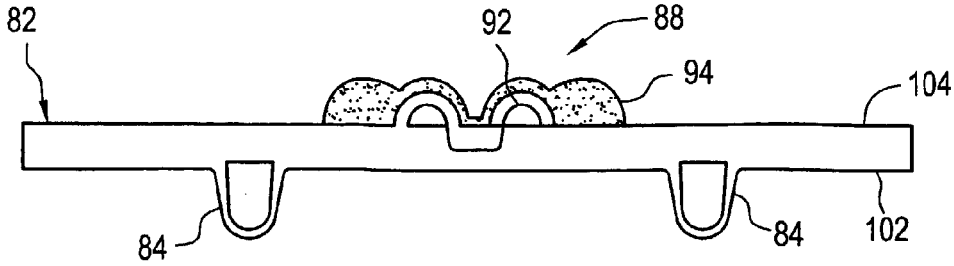
FIG. 3A is a cross-section on line Y—Y of FIG. 3.

FIGS. 3 and 3A illustrates another embodiment of a discharge lamp according to the present invention. The embodiment has a preferred external electrode geometry. The discharge lamp 80 includes laminated envelope 82, which has a first or front surface 102 and a second or back surface 104. External electrodes located at or near opposite ends of gas-discharge channel 84 are in communication with the gas-discharge channel through passageways 90. Tubulation port 86 is separate from the electrode. The external electrodes 88 comprise a conductive medium 94 disposed on electrode surface 92. The electrode surface forms a plurality of contiguous round receptacles, each with a rounded shape. Electrical leads 164, such as wires or other conduits, conduct a power source 160 with the external electrodes 88 to activate the lamp.

The conductive medium 94 is either applied as a coating or a film and includes but is not limited to conductive coatings, conductive epoxies, conductive inks, frit with conductive filler, and the like or mixtures thereof. An example of a conductive coating suitable as a conductive medium is indium tin oxide. A coating of indium tin oxide is formed by, but is not limited to sputtering, evaporation, chemical deposition and ion implantation.

Figure 4:
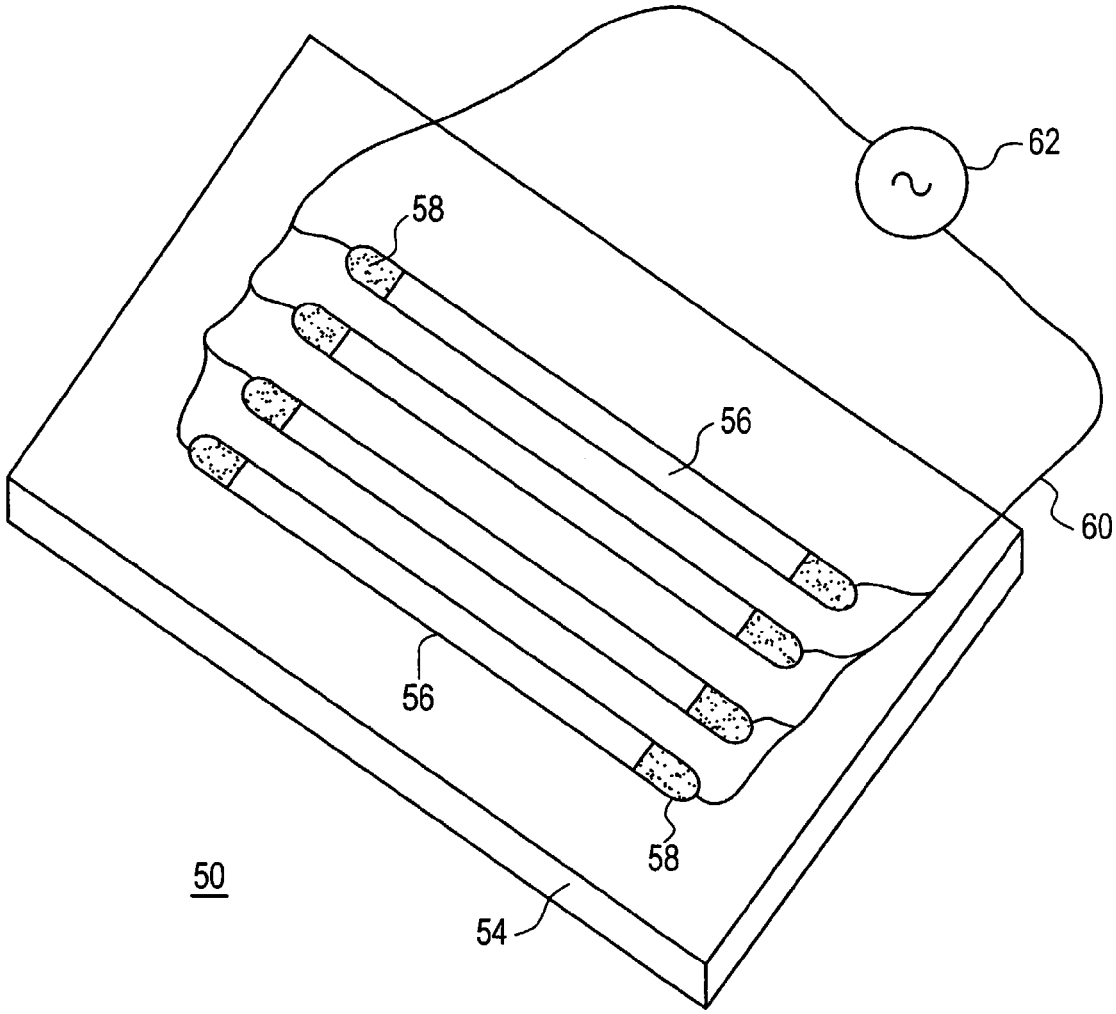
FIG. 4 is a perspective view of a discharge lamp comprising a laminated envelope, the laminated envelope including four separate gas-discharge channels, in a horizontal parallel arrangement, and external electrodes in communication with and located at opposite ends of each gas-discharge channel.

In a further embodiment a discharge lamp comprises a laminated envelope, where the laminated envelope comprises a plurality of separate gas-discharge channels and external electrodes in communication with said channels, whereby a discharge is driven in parallel, as illustrated in FIG. 4. Discharge lamp 50 comprises laminated envelope 54, wherein said laminated envelope comprises four separate gas-discharge channels 56, in a parallel arrangement. External electrodes 58 are in communication with and located at opposite ends of each gas-discharge channel 56. Connection to ballast 62 is made with connector leads 60.

Figure 5:
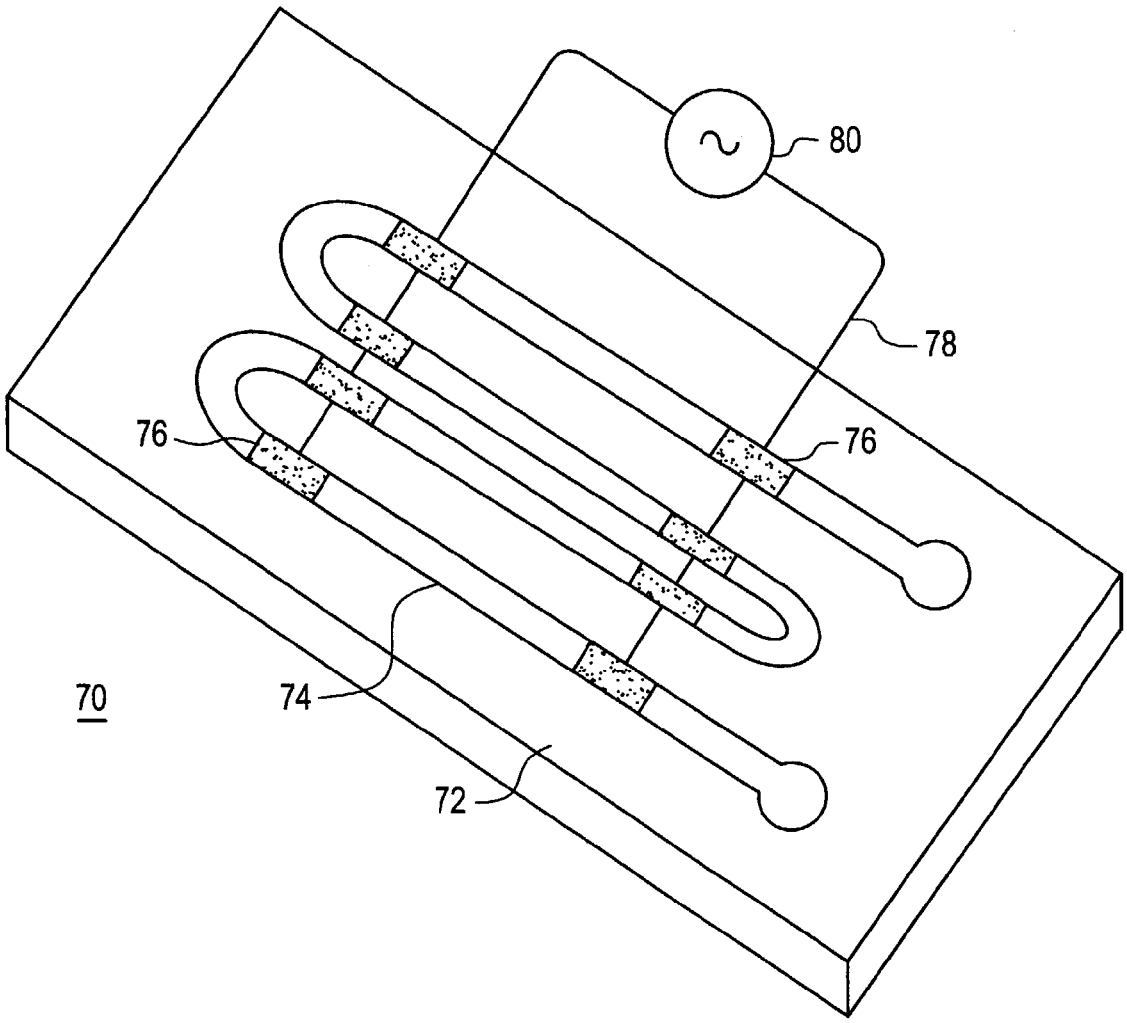
FIG. 5 is a perspective view of a discharge lamp comprising a laminated envelope, the laminated envelope including a continues gas-discharge channel in a serpentine configuration and external electrodes in communication with and located on each of the parallel sections of the gas-discharge channel.

FIG. 5 illustrates another embodiment of discharge lamp 70, which comprises a laminated envelope 72, with a continuous gas-discharge channel 74 in a serpentine configuration. External electrodes 76 are located on parallel sections of the gas-discharge channel 74. As shown, two

TABLE

| | 1 | | 2 | | 3 | | 4 | |
|---|---|---|---|---|---|---|---|---|
| | Internal Electrode Coupling | External Electrode Coupling | Internal Electrode Coupling | External Electrode Coupling | Internal Electrode Coupling | External Electrode Coupling | Internal Electrode Coupling | External Electrode Coupling |
| Frequency (kHz) | 28 | 292 | 29 | 278 | 28 | 285 | 28 | 290 |
| $R_L$ (kohms) | 50 | 50 | 50 | 50 | 50 | 50 | 50 | 50 |
| $C_R$ (kohms) | — | 9 | — | 50 | — | 8 | — | 6 |
| Light Output (lux) | 350 | 350 | 60 | 60 | 244 | 244 | 73 | 73 |
| Power (watts) | 45.8 | 45.8 | 9.4 | 9 | 36.8 | 34.5 | 12.2 | 12.5 |
| Light Emitting Efficiency (lux/watt) | 7.64 | 7.95 | 6.38 | 6.67 | 6.63 | 7.07 | 5.98 | 5.84 |

It has been observed that there is no fundamental difference in how power is applied to the discharge lamps of the following Table, i.e., whether the discharge is driven by internal or external electrode configurations, as long as the circuit is tuned to the proper operating frequency when driving through external electrodes, i.e., the frequency at which the greatest light emitting efficiency is achieved. In the laboratory experiment examples tuning was achieved with a variable frequency plasma generator. In a non-laboratory environment tuning may be achieved either through a self-tuning ballast or a ballast that is tuned to the circuit of each discharge lamp.

external electrodes, one at each end, are in capacitative communication with each section of the gas-discharge channel. Connection to ballast 80 is made with connector leads 78.

Figure 6:
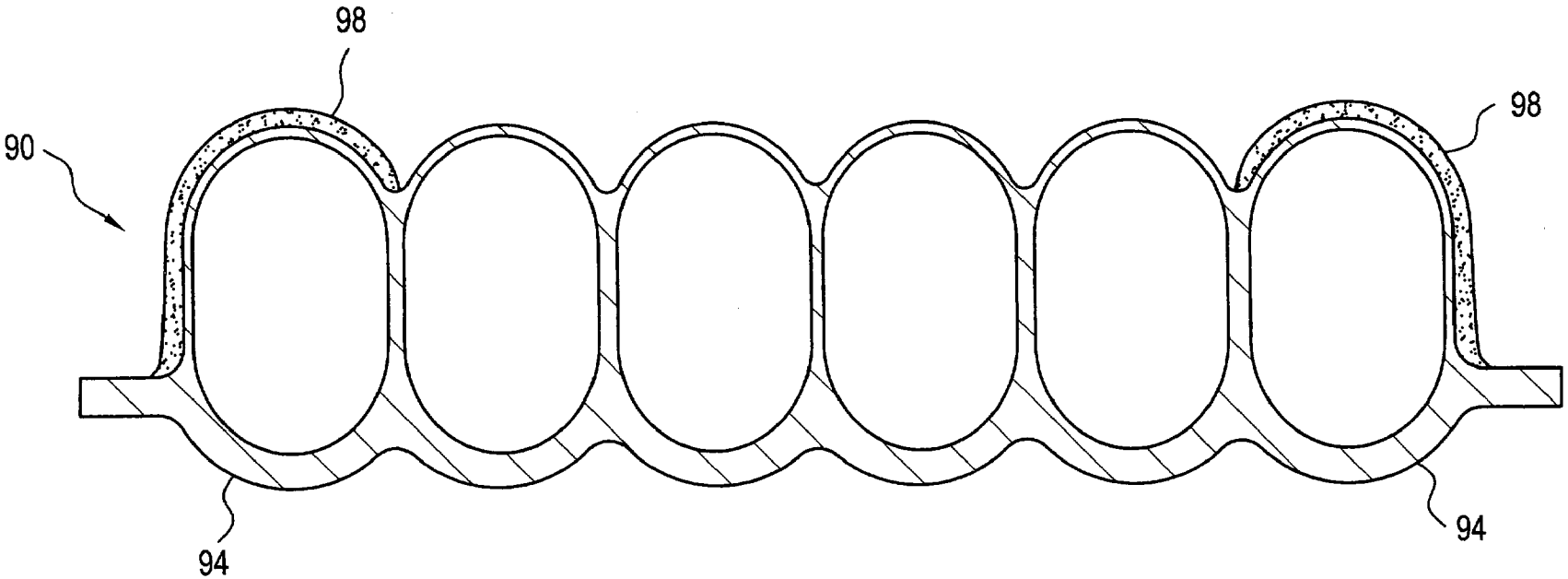
FIG. 6 is a cross-sectional view of a laminated envelope suitable for the discharge lamp of the present invention, the laminated envelope including a gas-discharge channel and external electrodes located on the outer top surface, at opposite ends of the gas-discharge channel.
Figure 6A:
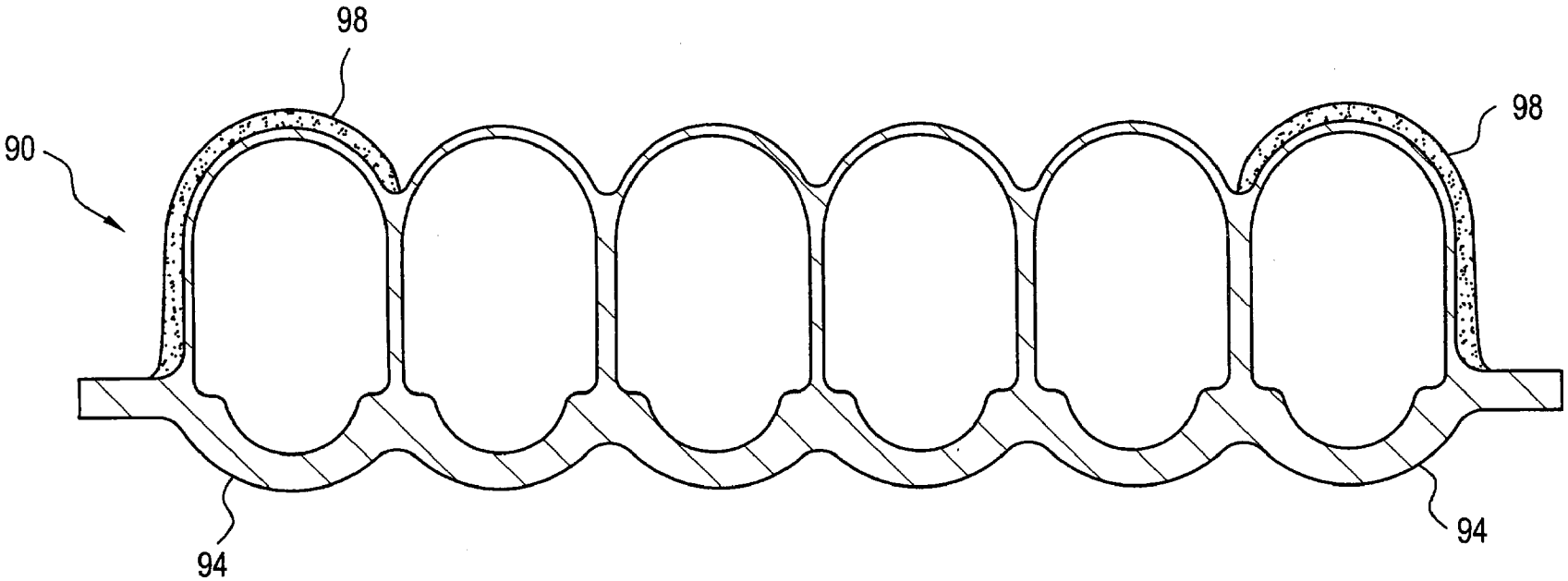
FIG. 6A is a cross-sectional view of a laminated envelope suitable for the discharge lamp of the present invention, the laminated envelope including a gas-discharge channel and external electrodes located on the outer top surface, at opposite ends of the gas-discharge channel.
Figure 6B:
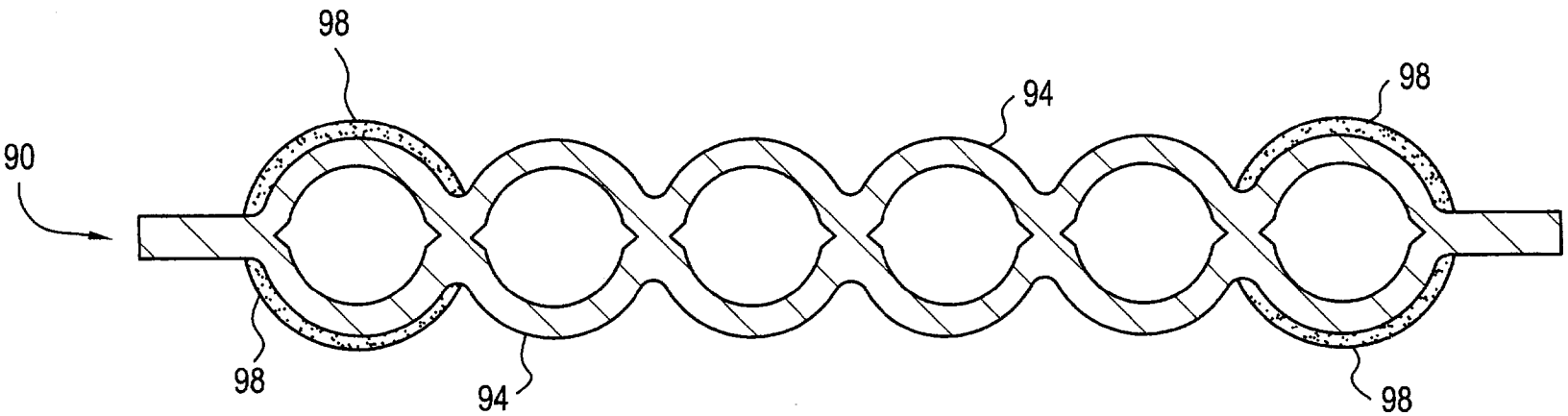
FIG. 6B is a cross-sectional view of a laminated envelope suitable for the discharge lamp of the present invention, the laminated envelope including a gas-discharge channel and external electrodes located on the outer top and bottom surfaces, at opposite ends of the gas-discharge channel.

Referring now to FIGS. 6, 6A, and 6B illustrated therein are cross-sectional views of further embodiments of laminated sheet envelopes suitable for the present invention. Laminated envelope 90 comprises gas-discharge channel 94 and external electrodes 98. In the embodiments illustrated in FIGS. 6 and 6A, the external electrodes are applied as a coating or film directly to the top outer surface of gas-discharge channel 94, and are located at each end of the channel. In the embodiment illustrated in FIG. 6B, the external electrodes are applied as a coating or film directly to the top and bottom outer surfaces of gas-discharge channel 94.

Although the now preferred embodiments of the invention have been set forth, it will be apparent to those skilled in the art that various changes and modifications may be made thereto without departing from the spirit and scope of the invention as set forth in the following claims.

What is claimed is:

1. A method for forming an electrode-driven discharge lamp, said method comprising:

(a) forming a laminated envelope comprising a front surface and a back surface integrated together to form a unitary envelope body, and at least a gas-discharge channel enclosed within said envelope, wherein said laminated envelope exhibits a weight to area ratio of about $\leqq 1.0$ g/cm$^2$;

(b) forming an electrode surface on said laminated envelope, said electrode surface being an integral part with said laminated envelope and being in capacitive communication with said gas-discharge channel; and (c) forming an external electrode at said electrode surface by depositing a conductive medium on said electrode surface, wherein said laminated envelope acts as an effective dielectric intermediate material between said external electrode and said gas-discharge channel.

2. The method according to claim 1, wherein said unitary envelope body is essentially free of any sealing materials.

3. The method according to claim 1, wherein said laminated envelope is made of a glass material.

4. The method according to claim 3, wherein said glass material of said laminated envelope is selected from: borosilicates, aluminosilictaes, boro-aluminosilicates, and soda-lime silicates.

5. The method according to claim 1, wherein said external e an electrode area and said laminated envelope at said electrode surface has an electrode thickness that enables efficient capacitive coupling at an operating frequency of about 100 kHz to 1000 kHz.

6. The method according to claim 5, wherein said laminated envelope has an electrode surface area in the range of about 6.54–25.81 cm$^2$.

7. The method according to claim 5, wherein said laminated envelope has an electrode thickness of in the range of about 0.5 mm to 1.5 mm.

8. The method according to claim 1, wherein said electrode surface is formed as an elongated receptacle.

9. The method according to claim 8, wherein said electrode surface is formed as a plurality of contiguous elongated receptacles.

10. The method according to claim 9, wherein said elongated receptacles are round.

11. The method according to claim 1, wherein said external electrode is in capacitive communication with a plurality of gas-discharge channels.

12. The method according to claim 11, wherein an electrical discharge is driven in parallel across said plurality of gas-discharge channels.

13. The method according to claim 1, wherein said laminated envelope comprises a plurality of separate, gas-discharge channels.

14. The method according to claim 1, wherein said gas-discharge channel is evacuated and backfilled with an ionizable gas.

15. The method according to claim 14, wherein said ionizable gas is selected from the group consisting of any noble gas or mixtures thereof.

16. The method according to claim 14, wherein said ionizable gas is neon, xenon, krypton, argon, helium, and mixtures thereof with mercury.

17. The method according to claim 1, wherein said conductive medium is selected from conductive tape, conductive coatings, conductive epoxies, conductive inks, fit with conductive fillers, and mixtures thereof.

18. The method according to claim 1, wherein said conductive medium is a coating of indium tin oxide.

19. The method according to claim 18, wherein said coating of indium tin oxide is formed by any one of the following processes: sputtering, evaporation, chemical deposition and ion implantation.

20. The method according to claim 1, wherein said laminated envelope comprises a gas-discharge channel having a serpentine configuration.

21. A method for forming an electrode-driven discharge lamp, said method comprising:

(a) forming a laminated envelope comprising a front surface and a back surface integrated together to form a unitary envelope body, and at least a gas-discharge channel enclosed within said envelope;

(1) forming an electrode surface on said laminated envelope, said electrode surface being an integral part with said laminated envelope and being in capacitive communication with said gas-discharge channel; and (c) forming an external electrode at said electrode surface by depositing a conductive medium on said electrode surface, wherein said laminated envelope acts as an effective dielectric intermediate material between said external electrode and said gas-discharge channel, wherein said external electrode enables efficient capacitive coupling at an operating frequency of about 250 kHz.

22. A method for forming an electrode-driven discharge lamp, said method comprising:

(a) forming a laminated envelope comprising a front surface and a back surface integrated together to form a unitary envelope body, and at least a gas-discharge channel enclosed within said envelope; wherein said gas-discharge channel is evacuated and backfilled with neon at a pressure of about 5–6 torr;

(1) forming an electrode surface on said laminated envelope, said electrode surface being an integral part with said laminated envelope and being in capacitive communication with said gas-discharge channel; and (c) forming an external electrode at said electrode surface by depositing a conductive medium on said electrode surface, wherein said laminated envelope acts as an effective dielectric intermediate material between said external electrode and said gas-discharge channel.

23. The method according to claim 22, wherein said neon at said pressure of about 5–6 torr is at 250 kHz.

24. A method for forming an electrode-driven discharge lamp, said method comprising:

(a) forming a laminated envelope comprising a front surface and a back surface integrated together to form a unitary envelope body, and at least a gas-discharge channel having a serpentine configuration enclosed within said envelope;

(b) forming an electrode surface on said laminated envelope, said electrode surface being an integral part with said laminated envelope and being in capacitive communication with said gas-discharge channel; and (c) forming an a plurality of external electrodes at said electrode surface in capacitive communication with, and located on parallel sections of said serpentine gas-discharge channel for driving an electrical discharge in said gas-discharge channel in parallel by depositing a conductive medium on said electrode surface, wherein said laminated envelope acts as an effective dielectric intermediate material between said external electrode and said gas-discharge channel.

* * * * *